US006889759B2

(12) United States Patent
Derosier

(10) Patent No.: US 6,889,759 B2
(45) Date of Patent: May 10, 2005

(54) FIN FOR HEAT EXCHANGER COIL ASSEMBLY

(75) Inventor: Gregory S. Derosier, Eldersburg, MD (US)

(73) Assignee: Evapco, Inc., Taneytown, MD (US)

( * ) Notice: Subject to any disclaimer, the term of this patent is extended or adjusted under 35 U.S.C. 154(b) by 24 days.

(21) Appl. No.: 10/603,510

(22) Filed: Jun. 25, 2003

(65) Prior Publication Data

US 2004/0261984 A1 Dec. 30, 2004

(51) Int. Cl.[7] ..... F28D 1/04

(52) U.S. Cl. ..... 165/151; 165/DIG. 399; 165/181

(58) Field of Search ..... 165/151, 181, 165/182, DIG. 399

(56) References Cited

U.S. PATENT DOCUMENTS

| | | | | |
|---|---|---|---|---|
| 1,920,313 A | | 8/1933 | Mautsch | |
| 3,397,741 A | * | 8/1968 | Gunter | 165/181 |
| 3,645,330 A | | 2/1972 | Albright et al. | |
| 4,296,050 A | * | 10/1981 | Meier | 165/166 |
| 4,480,684 A | * | 11/1984 | Onishi et al. | 165/179 |
| 4,668,443 A | * | 5/1987 | Rye | 165/166 |
| 4,705,105 A | | 11/1987 | Cur | |
| 4,735,775 A | * | 4/1988 | Leonard et al. | 165/179 |
| 5,009,263 A | * | 4/1991 | Seshimo et al. | 165/151 |
| 5,062,475 A | | 11/1991 | Bemisderfer et al. | |
| 5,111,876 A | * | 5/1992 | Nash | 165/151 |
| 5,124,087 A | * | 6/1992 | Bradley et al. | 261/112.2 |
| 5,168,923 A | * | 12/1992 | Sacks | 165/151 |
| 5,203,403 A | | 4/1993 | Yokoyama et al. | |
| 5,425,414 A | | 6/1995 | Bradley, Jr. et al. | |
| 5,505,257 A | | 4/1996 | Goetz, Jr. | |
| 5,775,413 A | | 7/1998 | Kawanabe et al. | |
| 5,799,725 A | | 9/1998 | Bradley, Jr. et al. | |
| 5,927,393 A | | 7/1999 | Richter et al. | |
| 5,950,716 A | * | 9/1999 | Appelquist et al. | 165/154 |
| 6,209,201 B1 | | 4/2001 | Yamada | |
| 2002/0066554 A1 | | 6/2002 | Oh et al. | |

* cited by examiner

*Primary Examiner*—Teresa J. Walberg
(74) *Attorney, Agent, or Firm*—Akin Gump Strauss Hauer & Feld, LLP

(57) ABSTRACT

A fin is disclosed for use in a heat exchanger coils including tube segments extending through the fin. The fin includes a corrugated sheet of material having a plurality of major corrugations, about 8 to about 24 corrugations per inch (2.54 cm), each major corrugation being a peak or a valley with an amplitude "h" at the peaks or the valleys perpendicular to a reference major plane equally bisecting the major corrugations, and a width "w"; a plurality of orifices; a collar perpendicular to the reference major plane and extending from the sheet around each of the orifices; and a generally flat area that is generally parallel to or generally coextensive with the reference major plane and that surrounds each collar. The major corrugations have angled walls extending from at least one of the peaks and valleys to the generally flat areas adapted to create a vortex when air travels over the fin. A ratio of "h" to "w" is about 0.32 to about 0.7.

32 Claims, 9 Drawing Sheets

48
30
32
34
47
46
42
44

40

46
34
w
h
48
32
44

4
26
34
32
30
47
38
40
42
d
f
4
48
β
40
44
46
42
42
44
46

FIN FOR HEAT EXCHANGER COIL ASSEMBLY

BACKGROUND OF THE INVENTION

The present invention relates to a fin for use as a part of a finned coil assembly for use in a heat exchanger. More particularly, the invention relates to a fin having a structure which enhances the heat exchange between the atmosphere and heat exchange fluid contained within segments of tubes passing through multiple fins of a finned coil assembly.

Evaporators or plate-finned coil heat exchangers typically comprise a bundle of numerous lengths of pipe or tubing in a square or staggered array, with numerous fins in the form of plates slid over and cross-sectionally surrounding the tubes. The plate fins have holes or orifices that correspond with the tube array geometry. The heat exchanger generally includes a fan or blower that causes air to flow through the finned coil assembly where the air flows generally parallel with respect to the fins and perpendicular with respect to the tubes. Typically, the fins have a formed collar surrounding each orifice so that the tube extending through the orifice fits securely and snugly into the fin. The collar allows the fin to remain in good thermal contact with the tube, thereby providing good heat transfer into or out of the tube. It is also known to have a planar area surrounding the collar and to provide the plate used to make the fin with corrugations.

An example of one type of heat exchanger coil assembly using fins, where the fins are corrugated and have collars including a planar area surrounding the collars is disclosed in Bradley et al. U.S. Pat. No. 5,425,414, assigned to the assignee of the present invention. Among various structural distinctions, one significant difference between the present invention and the fins used in the coil assembly of the aforementioned patent is the orientation of the corrugations with respect to the air flow. In the patent, air flows transverse to the axes of the corrugations. In the present invention, air flows generally parallel to the axes of the corrugations.

The structure of the fin of the present invention, particularly in the interface areas where the major corrugations join the generally flat areas surrounding the collars, provides for localized heat transfer increases due to the promotion of beneficial turbulence and boundary layer mixing. In addition, the present invention has a particular ratio of amplitude and frequency of the major corrugations with reference to the generally flat areas surrounding the collars and the tubes that also enhances heat transfer. In this industry, subtle and apparently minor changes in geometry and structure significantly affect the heat transfer characteristics.

BRIEF SUMMARY OF THE INVENTION

The present invention relates to a fin for use in a heat exchanger having coils including tube segments extending through the fin, the fin comprising a corrugated sheet of material having a plurality of major corrugations, each major corrugation comprising a peak or a valley adjacent a peak, each major corrugation having an amplitude of a distance "h" between the centerline of material forming the fin at a tip of a peak or a bottom of a valley and perpendicular to a reference major plane equally bisecting the major corrugations where the peaks join the valleys, each major corrugation having a width of a distance "w" corresponding to the width of a peak or a valley between the intersecting points of the reference major plane with adjacent major corrugations; a plurality of orifices adapted for insertion of the tube segments; a collar perpendicular to the reference major plane and extending from the sheet around each of the orifices; and a generally flat area that is generally parallel to or generally coextensive with the reference major plane and that surrounds each collar; the major corrugations in a region adjacent to the generally flat areas having at least one of first angled walls extending from the peaks to the generally flat areas and second angled walls extending from the valleys to the generally flat areas, the angled walls adapted to create a vortex when air travels over the fin; the number of major corrugations being about 8 to about 24 per inch (2.54 cm), the amplitude and width of the major corrugations having a relationship such that a ratio of the distance "h" to the distance "w" is about 0.32 to about 0.7.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
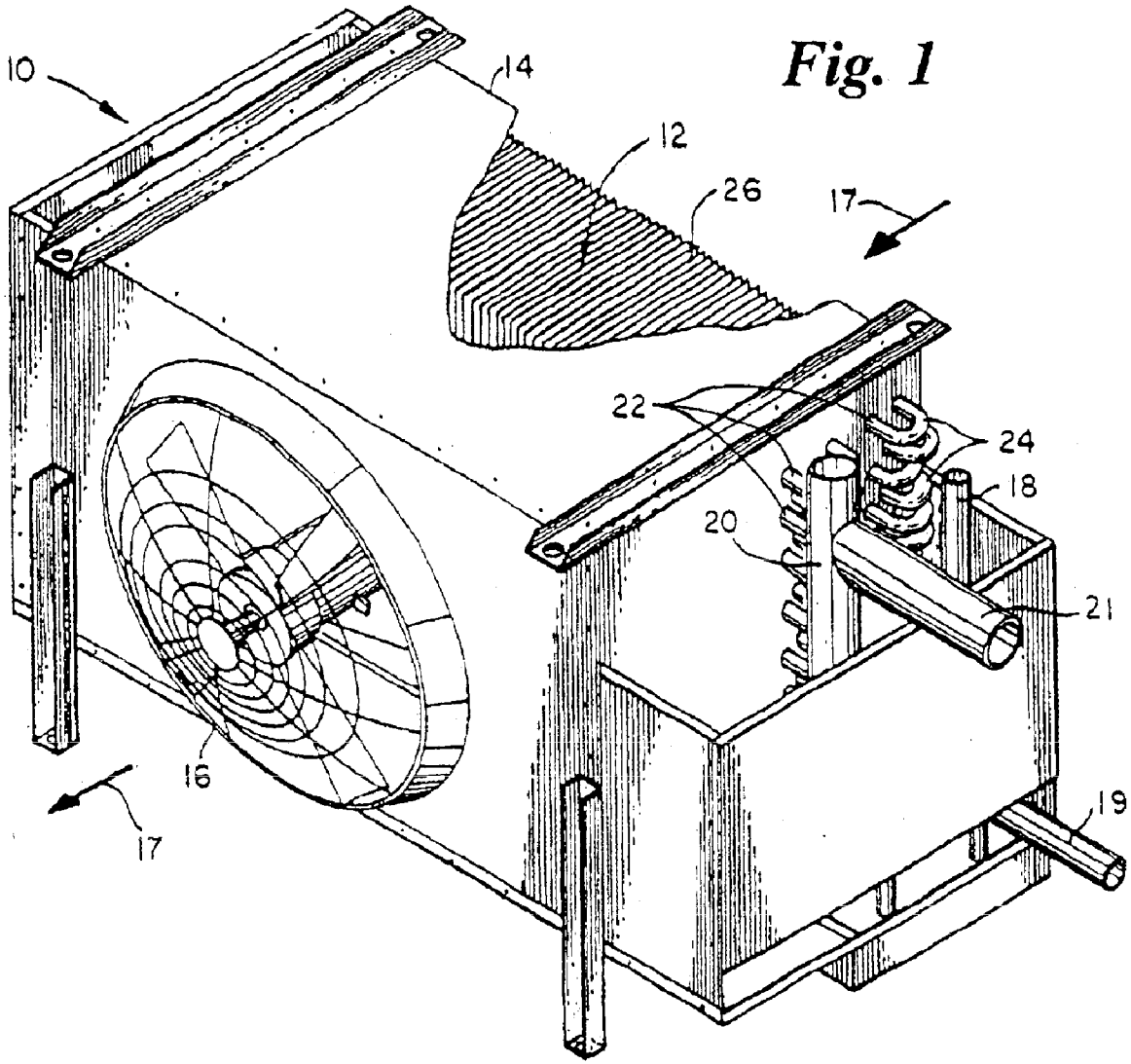
FIG. 1 is an isometric view showing one exemplary, non-limiting embodiment of a heat exchanger having a coil assembly including a tube array using fins according to the present invention, with a broken-away portion showing the fin structure of the coil assembly.

Certain terminology may be used in the following description for convenience only and is not limiting. The words "front," "rear," "left," "right," "top" and "bottom" designate directions in the drawings to which reference is made, where the fins are oriented vertically in a heat exchanger as shown and described hereinafter with respect to FIG. 1. The terminology includes the words specifically mentioned above, derivatives of such words and words of similar import. Furthermore, as used herein, the article "a" or "an" or a reference to a singular component includes the plural or more than one component, unless specifically and explicitly restricted to the singular or a single component, or unless otherwise clear from the context containing the term.

The invention will now be described in detail with reference to the drawings, wherein like numerals indicate like elements throughout the several views.

To help illustrate the environment in which the fins of the present invention are used, FIG. 1 shows one exemplary, non-limiting embodiment of a heat exchanger 10 having a finned coil assembly including a tube array, in which the fins of the present invention may be used. It should be understood that the particular details of the heat exchanger 10 do not form a part of the present invention, and that the fin of the present invention may be used with other types of heat exchangers having tubes including tube segments extending through the fins. In view of the foregoing, the exemplary heat exchanger 10 includes a finned coil assembly 12, a housing 14, and a fan or blower 16. In FIG. 1, arrows 17 indicate the direction of air flow being drawn through the heat exchanger, although it should be understood that the air may also move in the opposite direction or in any other direction as long as the air flow is generally parallel to the longitudinal axes of the major corrugations formed in the numerous, generally vertically oriented fins 26 of the present invention that comprise the coil assembly, as described hereinafter.

The heat exchanger 10 also includes an inlet manifold 18, an outlet manifold 20 and respective inlet and outlet pipes 19 and 21. Tubes having preferably straight tube segments 22 are joined by return tubes 24, sometimes referred to as bends, which are typically U-shaped to connect the ends of the tube segments. As is well known, an internal heat exchange fluid is circulated from an inlet source through the inlet pipe 19 and the inlet manifold 18, then through the coil assembly 12, and then through the outlet manifold 20 and the outlet pipe 21, so that heat is exchanged between the internal heat exchange fluid in the coil assembly 12 and air that is drawn through the coil assembly 12 by the fan 16.

The internal heat exchange fluid used in the heat exchanger 10 may comprise air, water, coolant or refrigerant fluid, or any other heat exchange fluid. Preferably, a refrigerant fluid is used. Accordingly, for purposes of explanation and not limitation, the present invention will be described primarily with reference to an embodiment of a heat exchanger used in cooling air conditioning or refrigeration applications. However, the fins of the present invention could also be used equally in heat exchangers used for heating or other types of applications, as well.

Figure 2:
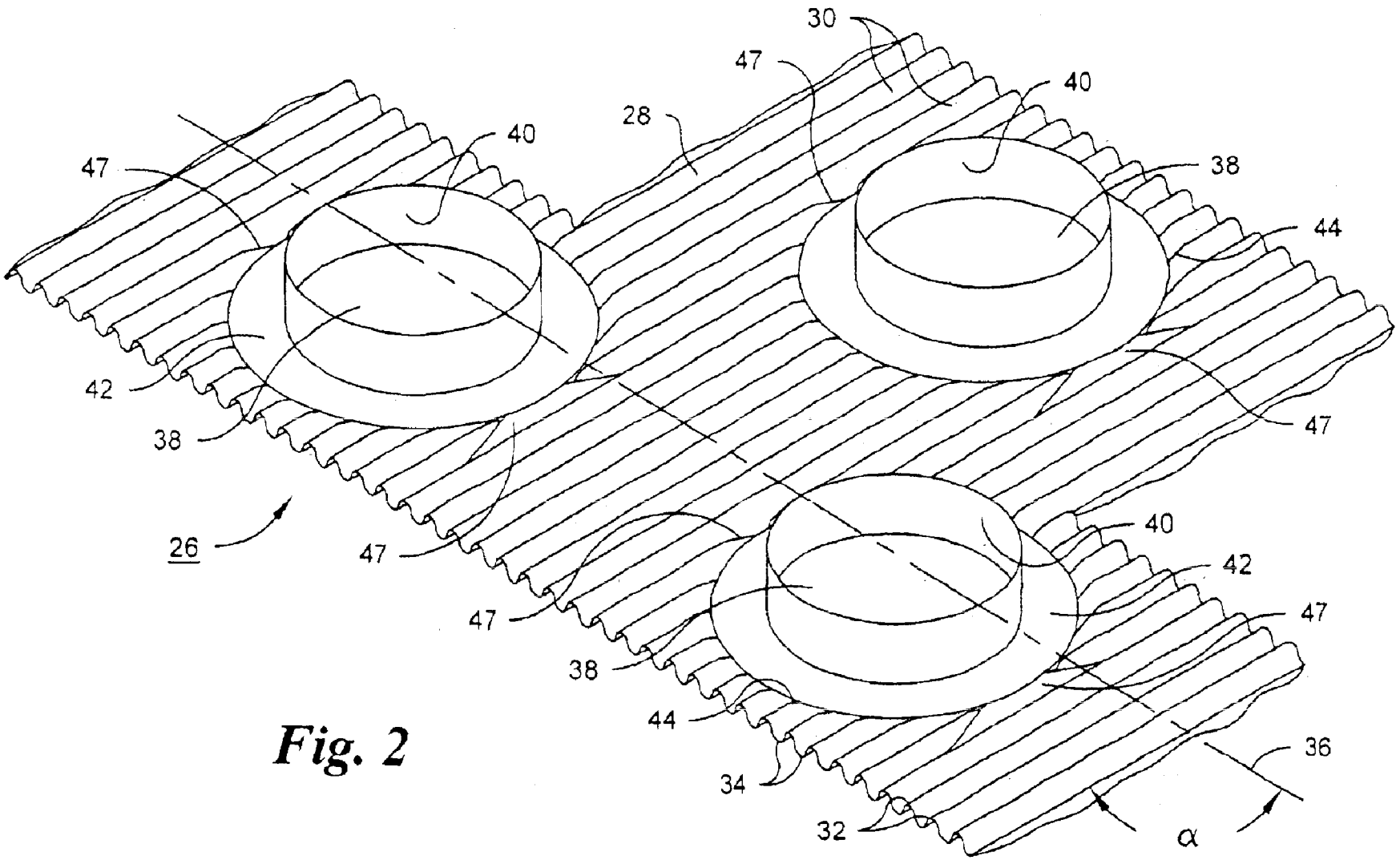
FIG. 2 is a front isometric view of a portion of one embodiment of a fin according to the present invention.

The fins 26 of the present invention will now be described primarily with reference to FIGS. 2–6. Initially, FIG. 2 is a front isometric view of a portion of one embodiment of a fin 26 according to the present invention. As shown in FIG. 1, the coil assembly 12 typically includes a large number of fins 26. The fin 26 is made from a plate or sheet 28 of material and is formed with a plurality of major corrugations 30. The material used in the sheet 28 from which the fin 26 is formed may be any material that has acceptable heat transfer characteristics. Typical sheet materials include aluminum, copper, alloys of aluminum, alloys of copper, steel, stainless steel, and the like. Prior to being formed into a corrugated sheet, the sheet of material 28 typically has a thickness of about 0.004 inch (0.1 mm) to about 0.020 inch (0.5 mm), preferably about 0.007 inch (0.18 mm) to about 0.016 inch (0.41 mm) and more preferably, about 0.010 inch (0.25 mm) to about 0.014 inch (0.36 mm). One preferred exemplary material is aluminum alloy 1100 for refrigeration and air conditioning applications.

The major corrugations 30 are formed of peaks 32 adjoining valleys 34. The major corrugations 30 are oriented along the fin 26 to be at an angle $\alpha$ with respect to a reference line 36, where the reference line 36 is preferably a vertical line. The major corrugation angle $\alpha$ preferably is about 60° to about 90°. As used herein with respect to any numerical value, the term "about" means the value indicated plus or minus 10%. At a reference angle $\alpha$ of 90°, with air flow in the direction of arrows 17 in FIG. 1 (corresponding to a direction from right to left when the sheets are oriented vertically as shown in the front elevation view of FIG. 3), there is less obstructed air flow through the finned coil 12 and a less powerful motor may be necessary to move air through the coil assembly. This may result in lower operating costs than if the corrugation angle $\alpha$ were toward the lower end of the range, say from about 60° to about 70°. When the corrugation angle $\alpha$ is in the mid-range between about 60° and about 90°, on the order of about 75°, drainage of cleaning fluid and defrosting liquid from frost which may build up between the fins is enhanced while air flow is not significantly impeded. Determination of the most appropriate corrugation angle $\alpha$ with respect to any given installation is well within the level of an ordinarily skilled engineer, without undue experimentation, in view of the present disclosure. As shown in FIG. 2, the corrugation angle $\alpha$ is 90°. The corrugation angle $\alpha$ is also 90° for the exemplary embodiments of FIGS. 7, 8, 10*a*, 11*a* and 12*a*.

A plurality of holes or orifices 38 are also formed in the sheet 28 used as the fin 26. The orientation of the orifices 38 may be any orientation as desired, taking into account the thermal performance requirements, the type of application of heat exchanger, and the like. The particular orientation of the orifices 38 in aligned or staggered rows or columns, horizontally and vertically, is a matter of design choice, as long as their placement takes into account the relationship of the structure surrounding the orifices 38 and the relationship of those structures to the corrugations as set forth hereafter.

The orifices can have any desired shape, such as circular, oval, elliptical, or the like. Also the orifices can have any desired size. The shape and size of the orifices 38 merely need to match the shape and size of the tube segments 22 extending through the orifices in the fins. Typical heat exchange applications include the use of tubes with circular cross-sections having an outside diameter of 0.625 inch (1.59 cm). Other applications in which fins of the present invention are intended to be used also involve tube segments 22 that have a circular cross-section and an outside diameter of 1.05 inch (2.67 cm). In the embodiments illustrated in FIGS. 2, 7–9, 10*a*, 11*a* and 12*a*, the orientation of the orifices 38 for the exemplary fins are shown for use with two segments having an outer diameter of 1.05 inch (2.67 cm), with the tubes spaced on 3.0 inch (7.62 cm) centers in a direction perpendicular to the axes of the major corrugations and 2.057 inch (5.52 cm) between rows of orifices in a direction parallel to the major corrugations. These particular embodiments show a fin for use with a staggered tube pattern, but the invention is not limited to any special positioning of tubes. Rather, these are merely exemplary and are provided with no intention of limiting either the shape or size of the tubes or the surrounding orifices 38 and collars 40 formed in the fins used in any given coil assembly.

Preferably surrounding each orifice 38 is a collar 40 extending from one major surface of the fin 26. As mentioned above, the collars 40 securely engage the linear tube segments 22 such that the surface area of engagement between the collar and the tube is enhanced, and the heat transfer between the tubes 22 and the fins 26 is likewise enhanced. While the diameters of the orifices 38 and the collars 40 surrounding the tube segments 22 must be slightly larger than the outside diameter of the tube segments, for the sake of convenience and explanation, the diameters of the orifices 38 and collars 40 will be referred to as being the same as the outside diameters of the tube segments extending through them. Additionally, the collars 40 provide a degree of structural stiffness when the fin is mounted on the linear tube segments 22.

The collars also maintain the fins 26 in alignment with each other, since the collars also provide a spacing function between adjacent fins 26, where the front surface of the collars 40 abuts the rear surface of the adjacent fin 26. The spacing of the fins 26 from each other may be determined based on the application of the heat exchanger, the materials used, the number and arrangement of tube segments within the coil assembly, and other factors well known to those ordinarily skilled in this technology in view of the present disclosure. In some applications, such as when the fin is used in the construction of industrial refrigeration coils for heat exchangers used in food processing and cold storage of perishable products, refrigeration coils typically operate at temperatures below the freezing point of water, and frost forms on the fin surface. To minimize detrimental performance impact of frost deposits on the fin surface, coils with relatively wide spacing between fins are commonly specified. The relatively wide fin spacing allows greater build up of frost (and consequently a longer time between defrosting cycles) on each fin surface before complete blockage of the air flow pathway occurs, than relatively narrow fin spacing. However, wider fin spacing results in lower coil thermal performance than a narrower spacing when no frost deposits are on the surfaces of the fins. Typical industrial refrigeration applications for evaporator-type heat exchangers have fins spaced at about 2 fins to about 8 fins per inch (2.54 cm) along the length of tube segments 22 used to form a coil assembly, such as the coil assembly 12. Air conditioning applications usually have fins spaced more densely, typically, and without limitation, about 10 to about 20 per inch (2.54 cm). One benefit of the present invention is a performance benefit of a longer time between defrosting cycles gained with wide fin spacing, while not penalizing coil thermal performance when frost has not formed or is not forming on the fin surfaces.

Surrounding a collar 40 is a generally flat area 42. As used herein, "generally flat" means that the area 42 may vary somewhat from a planar flatness, and may include an angled area of up to about 10° from a planar surface or the generally flat area 42 may have a slight degree of curvature, with a maximum angle of curvature, determined by an acute angle formed by a line tangent to the curve and a reference major plane 48 (see FIGS. 4 and 5) that equally bisects the major corrugations, of up to about 10°. The generally flat areas 42 surrounding the collars 40 are generally parallel to or generally coextensive with the reference major plane 48. As used herein, the term "generally" when used with respect to the relationship of a component to the reference major plane 48, such as the terms "generally parallel to" and generally coextensive with", means that the generally flat area need not be absolutely parallel to or absolutely coextensive with the reference major plane 48, but instead, may vary by angular variations of up to about 10°. It is preferred that, within reasonable manufacturing tolerances, the generally flat areas 42 are reasonably as flat as possible and that they are reasonably coextensive with the reference major plane 48. Other embodiments may have the generally flat areas 42 lie generally in planes generally parallel to the reference major plane 48. Such generally parallel planes may be at a level within the boundaries of reference planes along the tips of the peaks 32 and the bases of the valleys 34, or even outside the boundaries of the reference planes beyond the tips of the peaks 32 and the bases of the valleys 34.

Figures 3, 4, 5, 6:
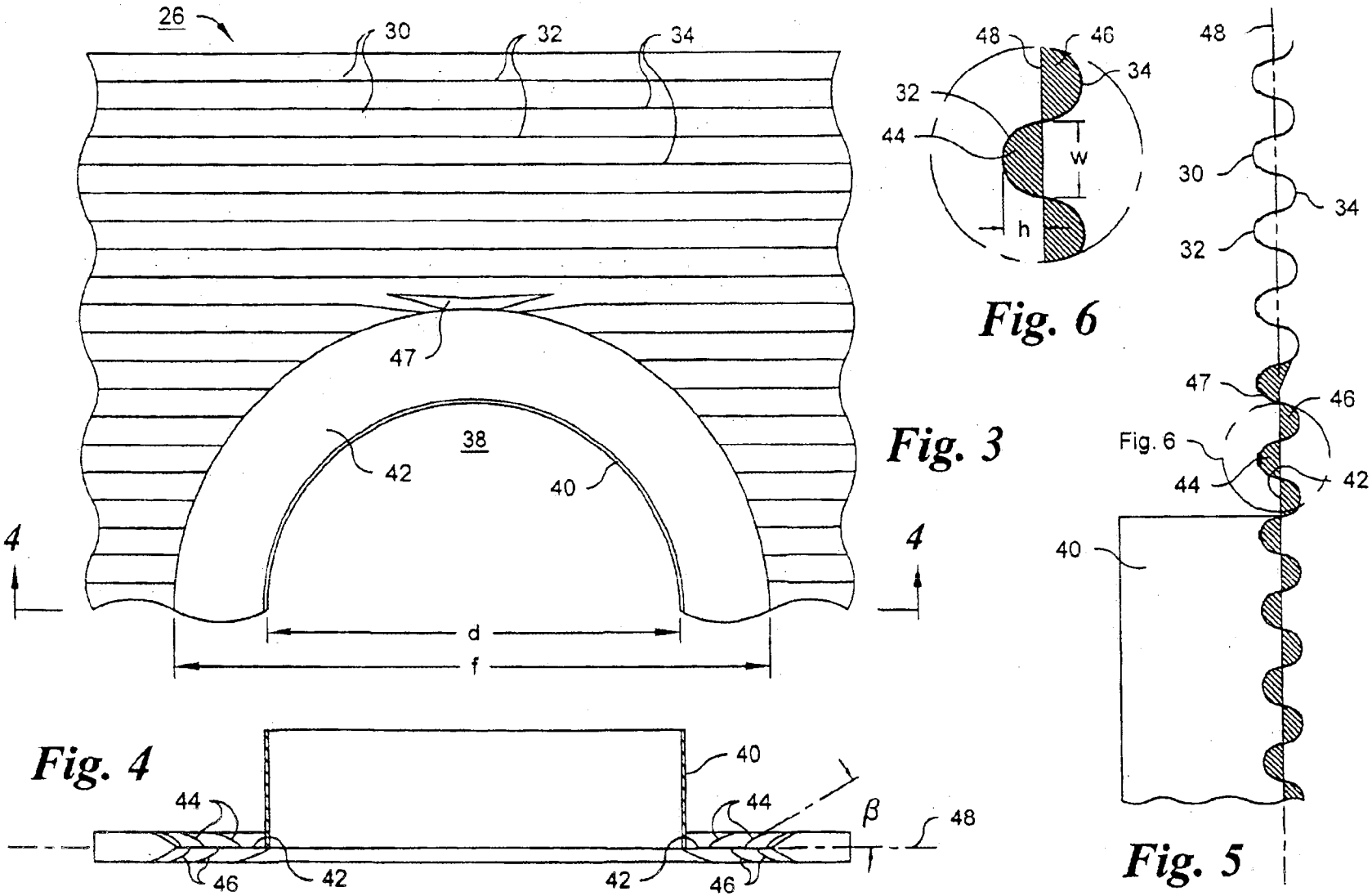
FIG. 3 is an enlarged, partial front elevation view of a portion of the fin shown in FIG. 2.
FIG. 4 is a horizontal cross-sectional view of a portion of a fin taken along lines 4—4 of FIG. 3.
FIG. 5 is a right side elevation view of a portion of a fin generally taken along the right-hand side of FIG. 3.
FIG. 6 is an enlarged area of a portion of the fin designated as "FIG. 6" in FIG. 5.

Some details of the fin 26 according to the present invention, relating to all embodiments, will now be discussed with reference primarily to FIGS. 3 through 6. FIG. 3 is a front elevation view of the fin 26, including the major corrugations 30 comprised of interconnected peaks 32 and valleys 34. A portion of an orifice 38 is shown, surrounded by a portion of a collar 40 and a portion of a generally flat area 42.

FIG. 4 is a horizontal cross-sectional view taken along lines 4—4 of FIG. 3 and shows the same components as discussed above primarily with reference to FIG. 2. In addition, FIG. 4 shows more clearly angled end walls 44 (also shown in FIGS. 2, 7, 8 and 9, as well as FIGS. 5 and 6), where the peaks 32 of the major corrugations 30 join the generally flat area 42, and angled end walls 46 (also shown in FIGS. 5 and 6) where the valleys 34 of the major corrugations 30 join the generally flat areas 42. In FIG. 4, a few of the angled walls 44 and 46 are shown as extending around the circumference of the generally flat area 42 and the collar 40.

In the views of FIGS. 5 and 6, partial and enlarged partial side views taken along the right-hand side of FIG. 3, the angled end walls 44 and 46 are shown, in essence looking at the rear face, rather than the front face of the angled walls. The angled walls 44 and 46 have important functional properties as described hereafter. As best seen in FIGS. 2, 3 and 6, there are also transition areas 47 where the side walls of the peaks 32 and the valleys 34 join with the generally flat areas 42. As depicted best in FIGS. 4, 7 and 8 (but also seen in FIG. 2), as the major corrugations reach the generally flat areas 42, angled end walls 44 and 46 are formed. FIG. 4 shows an angled wall angle β with respect to the reference major plane 48, where the reference major plane 48 equally bisects the peaks 32 and valleys 34.

The angled walls 44 and 46 define the transition length from a full amplitude of the major corrugation peak 32 or valley 34 to the generally flat area 42. It is preferred that this transition length be kept as short as possible, keeping in mind the gradual reduction in fin material deformation along this transition length, to maximize thermal performance without localized material failure due to stress concentration. The angled wall angle β may vary depending on the position of a peak or valley around the circumference of the generally flat area 42. The variable nature is a result of the nature and operation of the equipment, including such components as presses, tools and dies used to make the fin 26 according to the present invention. The angle β is typically the result of the intersection of a truncated cone and the peaks 32 and valleys 34 joining with the generally flat area 42, where the truncated cone has an axis coextensive with the axis of a line extending generally perpendicular to the reference major plane and aligned with the center point of the orifice 38 and the longitudinal axis of a tube passing through the orifice 38. Sharp angled corners where the angled walls 44 and 46 join with the major corrugation peaks 32 or valleys 34 and the generally flat areas 42 are generally preferred from a thermal performance enhancing aspect, due to stronger localized turbulence and vortex generation, but such sharp corners must be smoothed to prevent localized failure of the material used to make the fin 26. The radius for the smooth corners should be the minimum needed to produce an intact surface.

The angled walls 44 and 46 of the peaks 32 and valleys 34, respectively, where the peaks and valleys join with the generally flat areas 42, provide desired localized turbulence and boundary layer mixing to provide for enhanced localized heat transfer increases. To achieve these desired results, the angled walls should have an angle β (with reference to FIG. 4) of about 20° to about 60° with respect to the reference major plane 48. It is preferred that the angle β for the angled walls 44 and 46 be about 30° to about 50° with respect to the reference major plane. It is more preferred that the angled walls 44 and 46 have an angle β of about 45° with respect to the reference major plane.

The embodiments illustrated in the drawings relate to the embodiments where the generally flat areas 42 are generally coextensive with the reference major plane 48. In embodiments of the invention where the generally flat areas are generally parallel to, but not generally coextensive with the reference major plane 48, the angled walls 44 and 46 may have different lengths and angles. In embodiments where the generally flat areas 42 are located generally within boundaries of reference planes generally parallel to and along the tips of the peaks 32 and the bases of the valleys 34, but the generally flat areas 42 are not generally coextensive with the reference major plane, one set of angled walls 44 or 46 will be shorter and the corresponding opposed set of angled walls 46 or 44, respectively, will be longer. If the generally flat areas 42 are located generally coextensive with a plane along the tips of the peaks 32 or the bases of the valleys 34, there may only be one set of angled walls 44 or 46 For example, if the generally flat areas are located along the tips of the peaks 32, there would be no angled walls 44 extending from the peaks 32 to the generally flat areas 42, but there would be relatively long and more acutely angled walls 46 extending from the valleys 34 to the generally flat areas 42. If the generally flat areas 42 are located generally outside of the boundaries of reference planes along the tips of the peaks 32 or the bases of the valleys 34, one set of the angled walls 44 or 46 would be even longer and the opposed set of angled walls 46 or 44, respectively, would be angled at a direction opposite to the direction of the first set of angled wall 44 or 46, respectively. For example, if the generally flat areas 42 are beyond a reference plane along the tips of the peaks 32, the angled walls 46 from the valleys 34 to the generally flat area 42 would be even longer, and the angled walls 44 from the peaks 32 would extend from the peaks to the generally flat area at an opposite angle compared to the angle of the angled walls 46, with respect to the reference major plane 48. In any event, while the generally flat areas 42 preferably are located within the boundaries of reference planes along the tips of the peaks 32 and the bases of the valleys 34, even if the generally flat areas 42 are located beyond the boundaries of reference planes along the tips of the peaks or the bases of the valleys, sufficient turbulence and vortices would be generated by the existing set or sets of angled walls to be beneficial, as described herein.

As best shown in FIG. 6, the major corrugations have an amplitude having a distance "h" between the centerline of the sheet of material 28 forming the fin 26 at the peaks 32 or the valleys 34 and perpendicular to the reference major plane 48. The distance "h" is typically determined by measuring from the inside base of a valley to the tip of a peak from one side or surface of the sheet of material 28 used to make the fin 26, and then dividing that measurement in half. This assumes that the sheet of material 28 has a uniform thickness. The major corrugations 30 also have a width of a distance "w" corresponding to the width of a peak 32 or a valley 34 between the intersecting points of the reference major plane 48 with adjacent major corrugations, also as shown in FIG. 6.

The relationship of the amplitude of the major corrugations, the width of the major corrugations, the number of corrugations per unit of length and the angled end walls 44 and 46 with respect to the generally flat areas 42 all have a bearing on the thermal characteristics of the fin and, accordingly, the thermal performance of a coil 12 including a plurality of the fins 26, as well as the thermal performance of a heat exchanger 10 containing a coil assembly of the fins 26.

The fin 26 of the present invention includes about 8 to about 24 corrugations per inch (*2.54* cm). It is preferred that the fin 26 have about 10 to about 16 major corrugations per inch (2.54 cm), and more preferred that the fin 26 have about 12 to about 14 major corrugations per inch (2.54 cm). With respect to the two previously mentioned exemplary orifice diameters, matching the outside diameter of the exemplary tube segments 22 with which the fins of the present invention may be used, it is preferred that for an orifice 38 having a diameter of 0.625 inch (1.59 cm), there be 14 major corrugations per inch (2.54 cm), corresponding to 8.75 corrugations for such a diameter, and that for an orifice 38 having a diameter of 1.05 inch (2.67 cm), it is preferred that there be 13.33 major corrugations per inch (2.54 cm), corresponding to 14 major corrugations for such a diameter.

The amplitude (distance "h" with reference to FIG. 6) is best defined in relation to the width of a major corrugation (the width "w" of a peak 32 or a valley 34, with reference to FIG. 6). As will be apparent, the width of a peak or valley is the inverse of the number of major corrugations per unit length (such that, for example, when the major corrugation count equals 8 per inch (2.54 cm), the major corrugation width "w" equals ⅛ or 0.125 inch, (0.32 cm). Except for limitations imposed by the stretch of the material used to make the sheet 28 from which the fin 26 is formed, higher amplitude ratios are preferable to lower ratios. For a fin 26 of the present invention, the ratio of the major corrugation amplitude "h" to the major corrugation width "w" is about 0.32 to about 0.70, preferably about 0.4 to about 0.6, and more preferably about 0.45 to about 0.55. In one exemplary embodiment, where the orifices 38 have a diameter matching the outside diameter of the tube segment 22 of 0.625 inch (1.59 cm), the major corrugation amplitude-to-width ratio is preferably 0.49. For another exemplary embodiment of a fin 26 in which the orifices 38 have a diameter of 1.05 inch (2.67 cm), the ratio of the major corrugation amplitude to the major corrugation width is preferably 0.47.

The portion of the fin 26 that forms the generally flat areas 42 around the collars 40 is determined by the area needed to form the tube collars 40. For a given fin thickness, more fin area is needed to form collars that extend farther from the face of the generally flat area than collars that extend closer to the generally flat areas. In refrigeration applications, the fin collars 42 typically extend farther from the surface than for air conditioning applications. Thus, for these examples, the extent of the generally flat areas 42 needed for refrigeration applications would tend to be larger than for air conditioning applications. With reference to thermal performance, it is preferred that the ratio of the area of the generally flat area to the tube diameter area be relatively low, rather than relatively large, although an exact ratio is not critical to the proper functioning of the present invention. The ratio of the general flat area 42 to the area of the orifice 38 may be measured by their respective diameters for example, where the generally flat areas and orifices are circular, for instance. Based on this example, representative of the areas, the ratio of the cross-sectional dimension or diameter "f" of a circular generally flat area 42 and the cross-sectional dimension or diameter "d" of a circular orifice 38 (see FIG. 3), is preferably about 1.1 to about 3.0 and, more preferably, about 1.3 to about 1.9, corresponding to ratios of the cross-sectional areas of about 1.2 to about 9.0, respectively, and more preferably, about 1.7 to about 3.6, respectively.

For one exemplary fin 26 for use with tube segments 22 having an outside diameter of 0.625 inch (1.59 cm), where there is a ratio of generally flat area to orifice area of about 3.4, the generally flat area would have a diameter of about 1.16 inch (about 2.94 cm). For another exemplary embodiment, where the fin 26 is used with tube segments 22 having an outside diameter of 1.05 inch (2.67 cm), and a ratio of the generally flat area to the orifice area of about 2.4, the generally flat area would have a diameter of about 1.63 inch (about 4.14 cm). Both the ratios and the diameters (and corresponding areas calculated therefrom) are merely exemplary and can be varied based on the number and sizes of tubes in the array, their spacing, the number, width and amplitude of the corrugations, and the other factors disclosed herein, without undue experimentation in view of the present disclosure. The more important criteria are that there are generally flat areas 42 surrounding the collars 40 and where the corrugations intersect the flat portions. It is preferred that the corrugations intersect the flat areas at about the mid-point of the corrugation peaks and valleys, such that there are angled walls 44 and 46, respectively, formed where the peaks 32 and valleys 34 join the generally flat areas 42. This corresponds to the illustrated embodiment where the generally flat areas 42 are generally coextensive with the reference major plane 48. However, as described above, the generally flat areas 42 need not be generally coextensive with the reference major plane 48.

Figure 7:
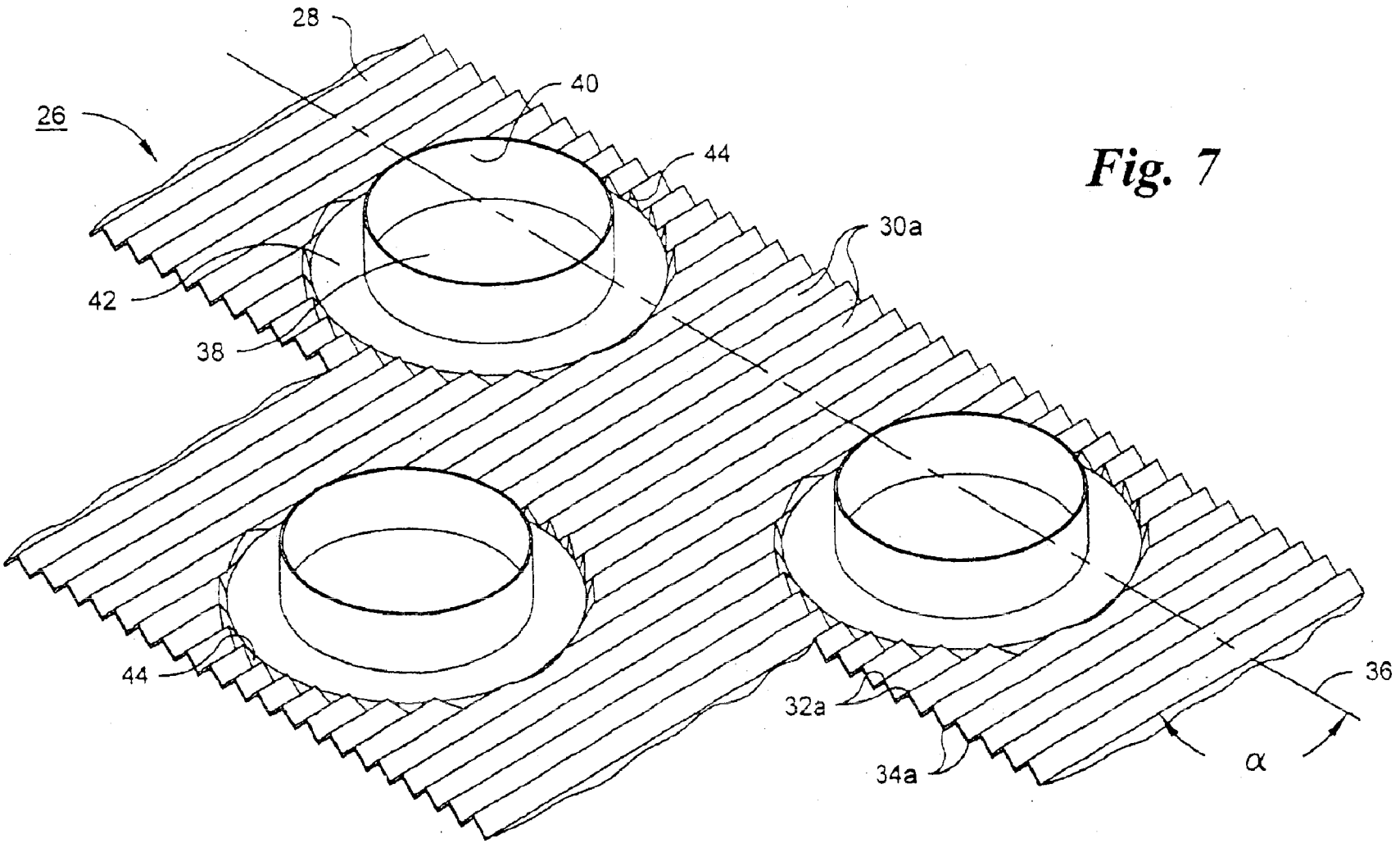
FIG. 7 is a front isometric view of a portion of another exemplary embodiment of a fin according to the present invention.
Figure 8:
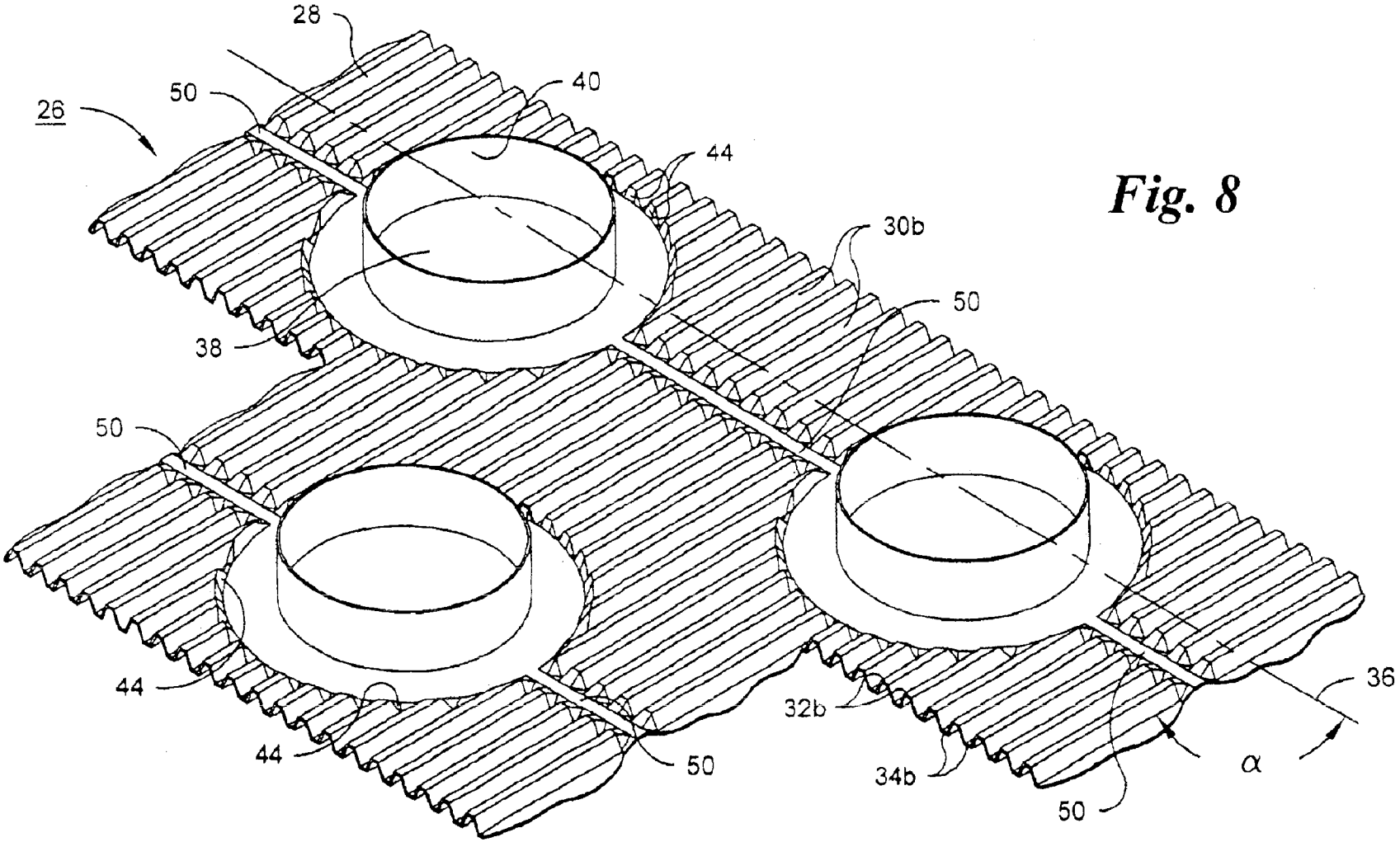
FIG. 8 is a front isometric view of a portion of yet another exemplary embodiment of a fin according to the present invention.
Figure 9:
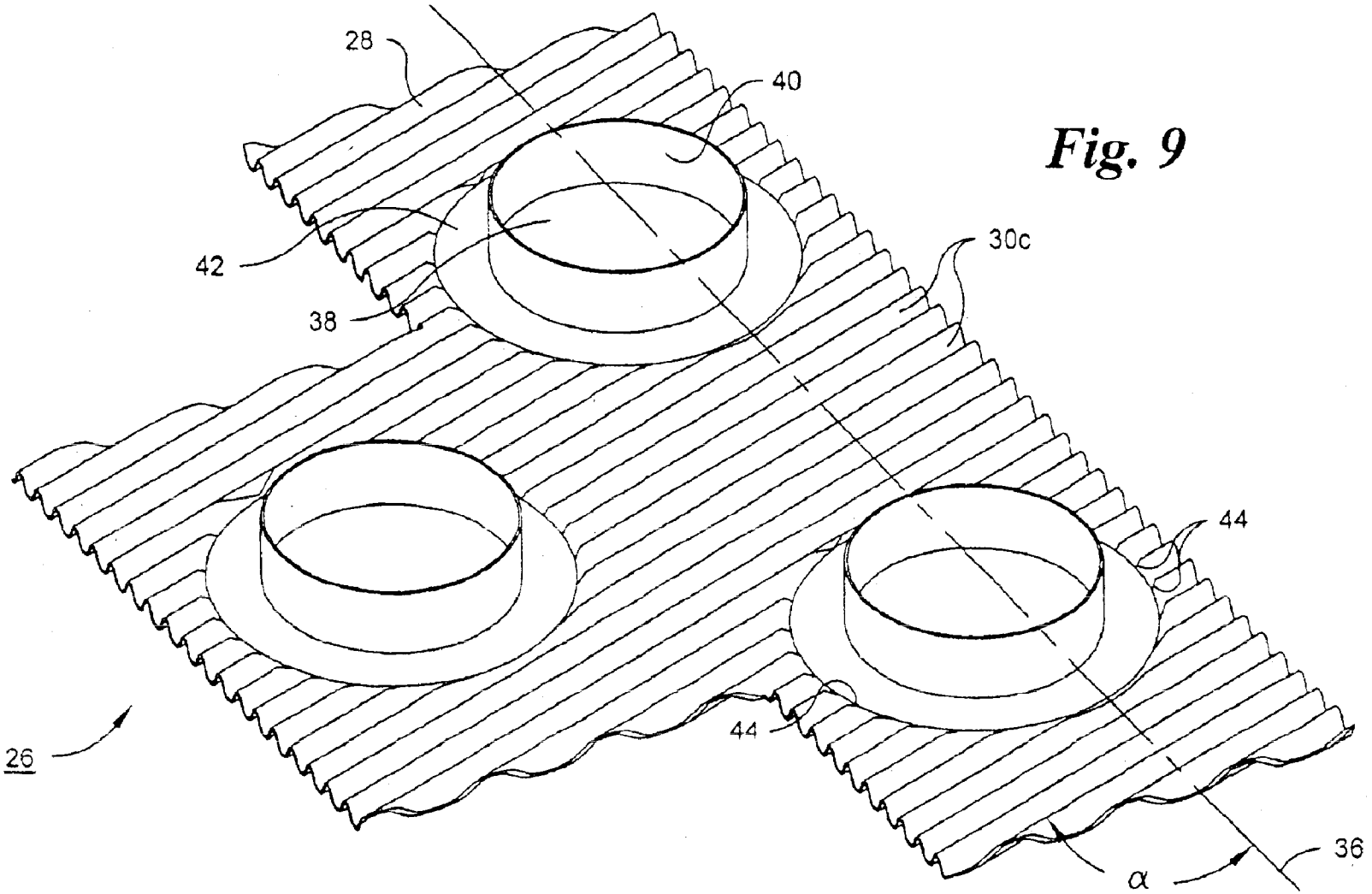
FIG. 9 is a front isometric view of a portion of still another exemplary embodiment of a fin according to the present invention.

Attention is now directed to alternative exemplary embodiments of the fin 26 shown in FIGS. 7 through 9. FIG. 7 is a front isometric view of a portion of a fin 26 formed from the sheet of material 28 and having major corrugations 30*a,* orifices 38, collars 40 and generally flat areas 42, similar to those shown in FIG. 2. Major corrugations 30*a* are shown as being oriented at a major corrugation angle $\alpha$ of 90° with respect to the vertical reference line 36. The fin 26 of FIG. 7 is distinguished from the fin 26 of the embodiment shown in FIG. 2 by the major corrugations 30*a* of the fin of FIG. 7 having peaks 32*a* and valleys 34*a,* where such peaks and valleys have a triangular cross-section, rather than a rounded curve cross-section as in the embodiment of FIG. 2.

FIG. 8 is a front isometric view of another exemplary alternative embodiment of a fin 26 made from a sheet of material 28 and having a plurality of major corrugations 30*b* at a major corrugation angle $\alpha$ of 90° with respect to the vertical reference line 36. One distinguishing feature of the embodiment of the fin 26 of FIG. 8 is that the major corrugations 30*b* are formed of peaks 32*b* and valleys 34*b* having a trapezoidal cross-section, rather than a rounded curve cross-section or a triangular cross-section as in the previously described specific embodiments. The various cross-sectional shapes of the peaks and valleys shown in FIGS. 2, 7 and 8 are merely exemplary and not limiting. Thus, the peaks and valleys could have other shapes, such as rectangular or any other compound shapes.

Additionally, FIG. 8 shows the use of optional drainage channels 50 preferably generally aligned with the center of the orifices 38 and generally flat areas 42 and extending in a generally vertical direction generally parallel to the vertical reference line 36. As used herein, the terms "generally vertical" and "generally parallel" relating to the orientation of the drainage channels 50 to the vertical reference line 36 means that the drainage channels are preferably but not necessarily vertical and parallel to the reference line 36, but in this instance, "generally vertical" and "generally parallel" may have a significant variation from the vertical, up to about 45°, as long as liquid, such as cleaning liquids and water defrosting from frost that may form on the surface of the fin 26, may readily flow downwardly along the fin 26. For more rapid and complete draining, it is preferred that the drainage channels 50 be as vertical as possible within reasonable manufacturing tolerances.

If desired, the drainage channels 50 may be located other than on the centerline of the orifices 38 and generally flat areas 42, and, for example, may be oriented to be at or near one of the lateral edges of the generally flat areas 42 or even in a location of the fin 26 not aligned in any way with an orifice 38 or a generally flat area 42. Moreover, the use of drainage channels 50 is optional in any of the embodiments of the fin 26 of the present invention, including the fin 26 shown in FIG. 8, as well as those embodiments described above or described hereafter. The use of the optional drainage channels 50 is only illustrated in FIG. 8, rather than in all of the other embodiments, merely for the sake of clarity of illustrations of the other embodiments.

FIG. 9 is a front isometric view of a portion of another exemplary embodiment of a fin 26 according to the present invention, made from a sheet of material 28 and having major corrugations 30*c*. As with the other embodiments of the fins 26, the fin of FIG. 9 includes a plurality of orifices 38, surrounding collars 40 and further surrounding generally flat areas 42. The distinguishing aspect of FIG. 9, compared to the other previously described embodiments is that major corrugation angle $\alpha$ is illustrated as being 75°, rather than 90° as in the previously described embodiments.

Additional alternative embodiments of the fin 26 according to the present invention will now be described with reference to FIGS. 10*a,* 10*b,* 11*a,* 11*b,* 12*a* and 12*b*.

Figure 10B:
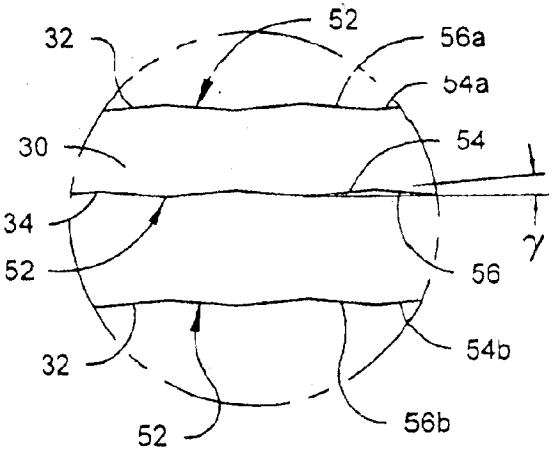
FIG. 10*b* is an enlarged area of a portion of the fin designated "FIG. 10*b*" in FIG. 10*a;*
Figure 10A:
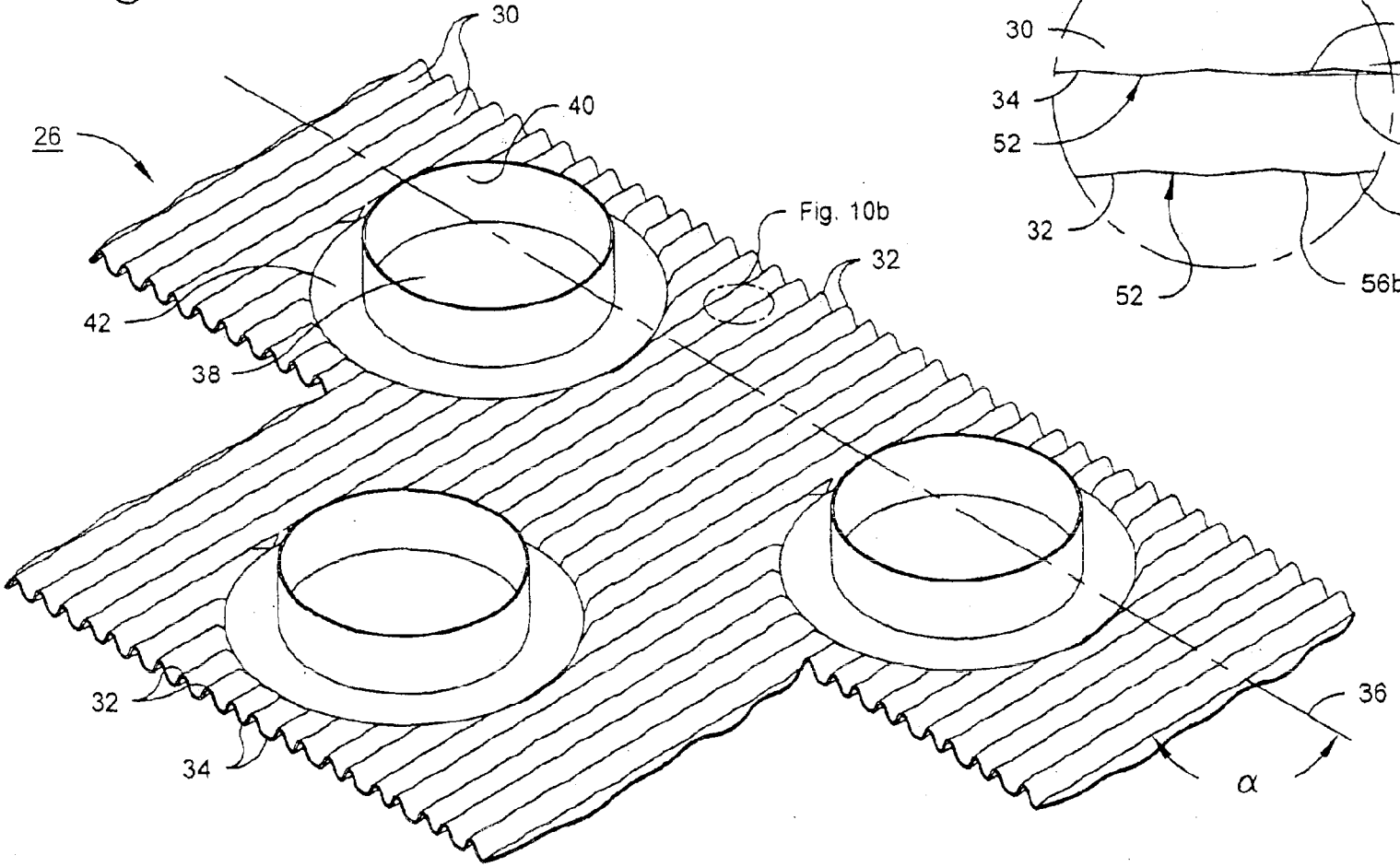
FIG. 10*a* is a front isometric view of a portion of yet another exemplary embodiment of a fin according to the present invention.
Figure 11B:
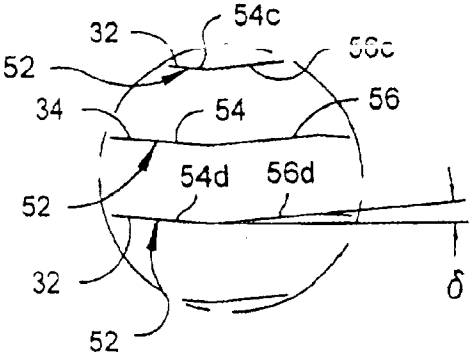
FIG. 11*b* is an enlarged area of a portion of the fin designated "FIG. 11*b*" in FIG. 11*a;*

With reference to FIGS. 10*a* and 10*b,* there is shown in FIG. 10*a* a front isometric view of a portion of another exemplary embodiment of a fin 26 having the components and characteristics previously described. In FIG. 10*a,* however, the major corrugations 30 have along their length minor corrugations 52. Details of the minor corrugations are best seen in FIG. 10*b,* identified by the region designated "FIG. 10*b*" in FIG. 10*a*. FIG. 10*b* shows a portion of the fin 26 including two adjacent peaks 32 and an intervening valley 34. The minor corrugations 52 are in a plane generally parallel to the reference major plane 48. As used herein, "generally" in the term "generally parallel" in reference to the minor corrugations with respect to the reference major plane has the same meaning as set forth above with respect to the use of "generally" in the term "generally parallel" in reference to the generally flat area 42. The minor corrugations 52 comprise undulations 54 in a first direction along a peak or valley and undulations 56 in a second direction along a peak or valley. As shown in FIG. 10*b,* the minor corrugations in the first direction 54 vary at an angle γ from the axis of the major corrugations 30. With reference to FIG. 11*b,* having similar minor corrugations 52 in a somewhat different relationship to be described hereafter, undulations 56, such as undulation 56*d,* in the second direction may vary from the axis of the major corrugation 30 by an angle δ. The undulating angles γ and δ individually may be measured with respect to the axes of the major corrugations to have preferable values of about 2° to about 8°, and more preferable values of about 4° to about 6°, such as 5°, for example.

The undulation frequencies and amplitudes of the minor corrugations 52 may vary within a wide range and are for the purpose of enhancing thermal performance by creating additional small degrees of beneficial turbulence, without creating an unacceptable air-side pressure drop. In the embodiment of the fin 26 shown in FIGS. 10*a* and 10*b,* the undulations 54 and 56 in first and second directions, respectively, along the valley 34 are out of phase (shown as 180° out of phase, for example, and not by way of limitation) with respect to like undulations in a first direction 54*a* and 54*b* along adjacent peaks 32. Likewise, undulations 56 in the second direction along the valley 34 are shown out of phase in FIG. 10*b* with like undulations in the second direction 56*a* and 56*b* on adjacent peaks 32.

Figure 11A:
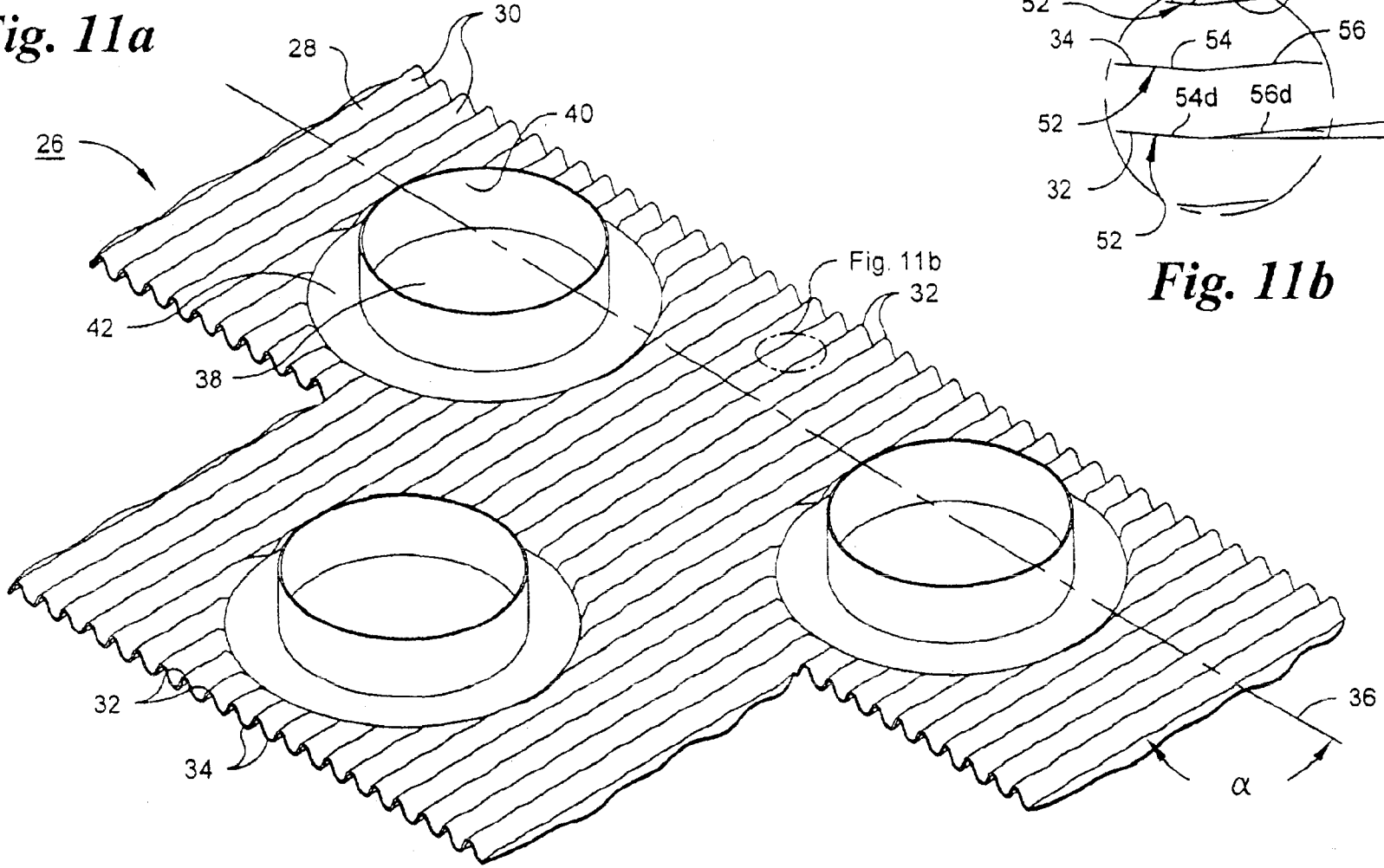
FIG. 11*a* is a front isometric view of a portion of still another exemplary embodiment of a fin according to the present invention.

FIGS. 11*a* and 11*b* show an alternative, exemplary embodiment of a fin 26 similar to that just described with respect to FIGS. 10*a* and 10*b,* and having minor corrugations 52 extending along the major corrugations 30. However, in the embodiment of FIGS. 11*a* and 11*b,* seen most clearly in the enlarged view of FIG. 11*b,* the undulations of the minor corrugations 52 along with peaks are in phase with the minor corrugations 52 along the valleys. Thus, the undulation 54 in the first direction along the valley 34 is in phase with the undulations 54*c* and 54*d* in the first direction of adjacent peaks 32. Likewise, the undulation 56 in the second direction along the valley 34 is in phase with the undulations 56*c* and 56*d* in the second direction of adjacent peaks 32.

As shown in each of FIGS. 10*b* and 11*b,* the minor corrugations 52 along adjacent peaks 32 are in phase with each other and the minor corrugations 52 along adjacent valleys 34 are also in phase with each other, regardless of whether the minor corrugations of a peak 32 and an adjacent valley 34 are out of phase (FIG. 10*b*) or in phase (FIG. 11*b*). If desired, the minor corrugations 52 along adjacent peaks 32 may be out of phase with respect to each other and the minor corrugations 52 along adjacent valleys 34 may also be out of phase with respect to each other, regardless of whether the minor corrugations of a peak and an adjacent valley are in phase or out of phase.

Figure 12B:
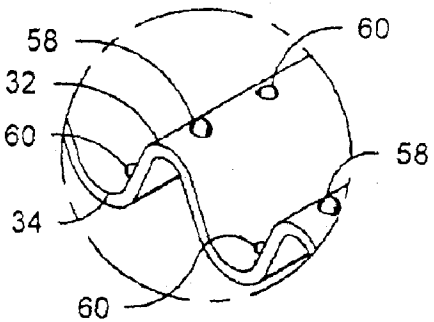
FIG. 12*b* is an enlarged area of a portion of the fin designated "FIG. 12*b*" in FIG. 12*a*.
Figure 12A:
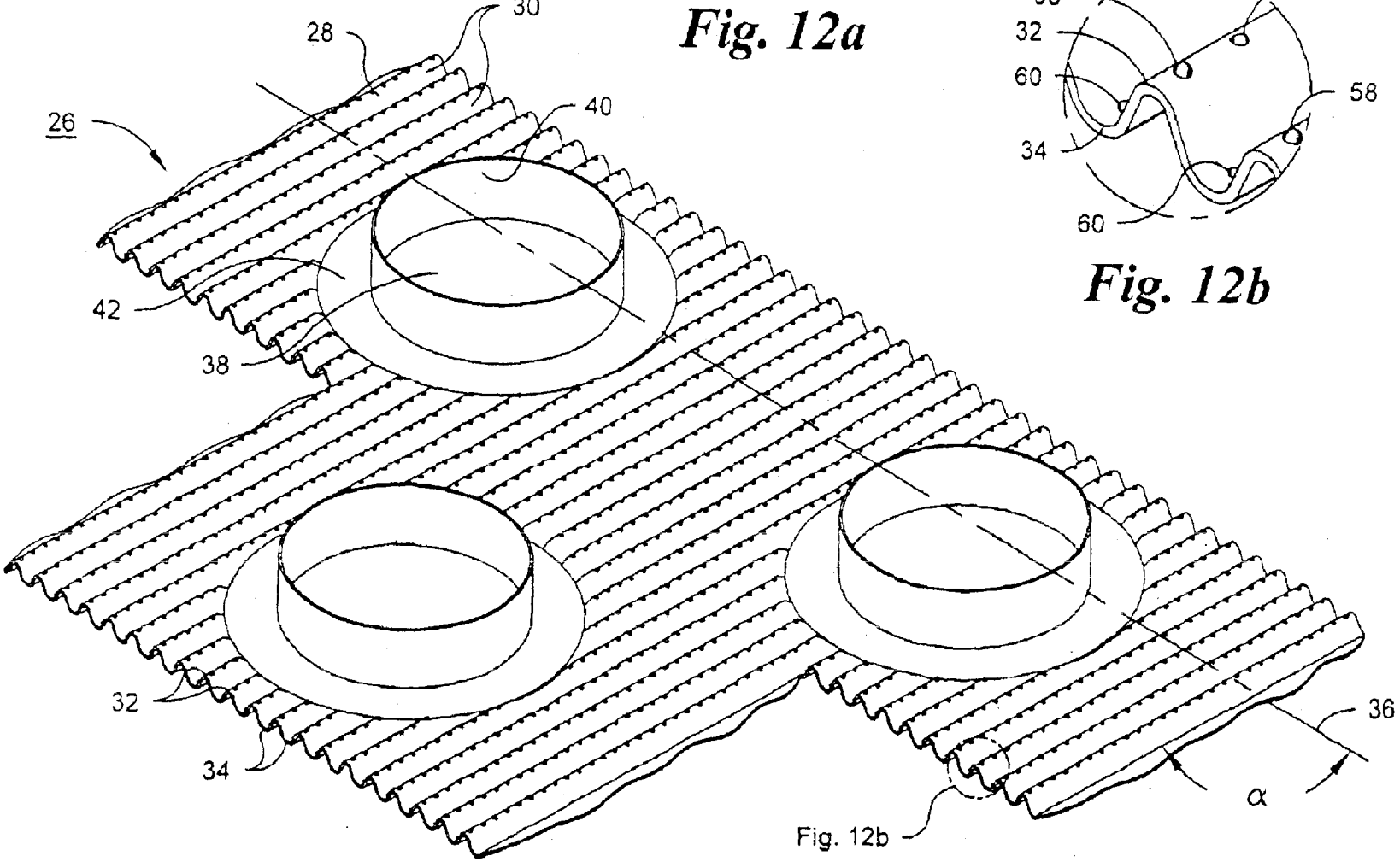
FIG. 12*a* is a front isometric view of a portion of yet another exemplary embodiment of a fin according to the present invention.

Yet another exemplary embodiment of a fin 26 according to the present invention is illustrated in FIGS. 12*a* and 12*b,* where FIG. 12*b* is an enlarged view of the portion of FIG. 12*a* identified as "FIG. 12*b*". The embodiment 26 shown in FIGS. 12*a* and 12*b* may have any of the configurations of the various embodiments of the fin 26 previously described and illustrated in any of the other figures. The embodiment of FIGS. 12*a* and 12*b,* however, comprises a plurality of bumps 58 extending from at least one surface of the peaks and valleys. If desired, instead of a plurality of bumps 58 extending from at least one surface of the peaks and valleys, the fin 26 may comprise a plurality of dimples 60 extending into at least one surface of the peaks and valleys. In the embodiment shown in FIGS. 12*a* and 12*b,* each peak 32 and valley 34 has alternating bumps 58 and dimples 60 formed in their opposite surfaces along the full length of the peaks 32 and valleys 34. The size, orientation and interrelationship of the bumps 58, dimples 60, or bumps and dimples together with respect to either or both surfaces of the fin 26 and with respect to either or both of the peaks 32 and valleys 34 may be varied. The variations depend on empirical determinations of how the bumps, dimples or bumps and dimples affect thermal performance, pressure drop and efficiency of a heat exchanger having a coil made of fins 26 having such components, and may be determined readily without undue experimentation or an empirical basis by a person of ordinary skill in this technology, in view of the present disclosure.

In general, the fins 26 of the present invention can be made using ordinary machining equipment, starting with a flat sheet of material 28. The major corrugations 30 may be formed using flat or rolling presses, where the uncorrugated regions correspond to the locations where the generally flat areas 42 are formed. Once the generally flat areas 42 are formed, collars 40 are formed by deforming the generally flat areas outwardly toward one face of the sheet to the desired extent, creating a type of high-hat structure. Thereafter, dies or other tooling are used to punch or otherwise form holes in the high hats, leaving the collars 40 intact. The particular techniques, equipment and details of this operation would be readily apparent to those ordinarily skilled in this technology without undue experimentation in view of the present disclosure.

As mentioned above, the fins 26 of the present invention provide a finned coil assembly 12 and a heat exchanger 10 containing it with enhanced benefits, especially when compared to fins made of flat sheets of material or even when compared to corrugated fins in which the major corrugations are transverse to the air flow, and further, even with respect to other corrugated fins having different structural relationships than those discussed above. The interrelationship of the major corrugation amplitude, frequency, angled walls 44 and 46, generally flat areas 42, as well as the shape, size, number and spacing of the tube segments 22 extending through the fins 26 provides enhanced thermal performance and efficiency, as well as other operational benefits. Heat exchangers using finned coil assemblies made of the fins of the present invention have obtained a performance improvement, at a fin spacing of three fins per inch (2.54 cm) of about 23% over flat fins of a comparable thickness and spacing, when matched with the same air flow system. This is a significant improvement over similar heat exchangers using finned coil assemblies of corrugated fins where the axes of the fins are transverse to the direction of air flow, which are believed to have performance improvements of up to about 11% over similar finned coil heat exchangers where the fins are not corrugated, when matched with the same air flow system.

Other operational enhancements, in addition to better thermal performance and greater thermal efficiency without an adversely escalating cost, include ease in maintaining and cleaning coil assemblies made of the fins 26, and the heat exchangers using them. For example, in open food processing applications, coil cleanliness is important to safe food production. Coils must be cleaned on a regular basis to prevent build up of debris and organisms that could contaminate foods being processed. Often, high pressure water and detergent sprays are used to clean coil assemblies and heat exchangers. With the present invention, since such sprays are often applied to the side, having major corrugations running side-to-side in the direction of the air flow aids in the effective high pressure cleaning of the surfaces of the fins. Additionally, enhanced drainage is achieved, especially where embodiments of the fins 26 use the optional drainage channels 50. The fins of the present invention, as a result of the structural interrelationship of the components, including the major corrugations having the designated relationship of amplitude and corrugation width, angled walls and other factors discussed above, provide a fin with strength sufficient to withstand thorough cleaning with higher pressure sprays of water and detergent.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A fin for use in a heat exchanger having coils including tube segments extending through the fin, the fin comprising a corrugated sheet of material having a plurality of major corrugations, each major corrugation comprising a peak or a valley adjacent a peak, each major corrugation having an amplitude of a distance "h" between the centerline of material forming the fin at a tip of a peak or a bottom of a valley and perpendicular to a reference major plane equally bisecting the major corrugations where the peaks join the valleys, each major corrugation having a width of a distance "w" corresponding to the width of a peak or a valley between the intersecting points of the reference major plane with adjacent major corrugations;

a plurality of orifices adapted for insertion of the tube segments;

a collar perpendicular to the reference major plane and extending from the sheet around each of the orifices; and a generally flat area that is generally parallel to or generally coextensive with the reference major plane and that surrounds each collar;

the major corrugations in a region adjacent to the generally flat areas having at least one of first angled walls extending from the peaks to the generally flat areas and second angled walls extending from the valleys to the generally flat areas, the angled walls adapted to create a vortex when air travels over the fin;

the number of major corrugations being about 8 to about 24 per inch (2.54 cm), the amplitude and width of the major corrugations having a relationship such that a ratio of the distance "h" to the distance "w" is about 0.32 to about 0.7.

2. The fin of claim 1 wherein the peaks and valleys have a transverse cross-sectional shape selected from the group consisting of a rounded curve cross-sectional shape, a triangular cross-sectional shape and a trapezoidal cross-sectional shape.

3. The fin of claim 2 wherein the peaks and valleys have a rounded curve transverse cross-sectional shape.

4. The fin of claim 2 wherein the peaks and valleys have a triangular transverse cross-sectional shape.

5. The fin of claim 2 wherein the peaks and valleys have a trapezoidal transverse cross-sectional shape.

6. The fin of claim 1, wherein each of the first and second angled walls independently is at an angle of about 20° to about 60° with respect to the reference major plane.

7. The fin of claim 6, wherein each of the first and second angled walls independently is at an angle of about 30° to about 50° with respect to the reference major plane.

8. The fin of claim 7, wherein each of the first and second angled walls is at an angle of about 45° with respect to the reference major plane.

9. The fin of claim 1, wherein the major corrugations have axes parallel to a line of about 60° to about 90° with respect to a vertical line when the fin is vertically oriented.

10. The fin of claim 9, wherein the major corrugations have axes parallel to a line of about 90° with respect to a vertical line when the fin is vertically oriented.

11. The fin of claim 9, wherein the major corrugations have axes parallel to a line of about 75° with respect to a vertical line when the fin is vertically oriented.

12. The fin of claim 1, wherein the amplitude and width of the major corrugations have a relationship such that the ratio of the distance "h" to the distance "w" is about 0.4 to about 0.6.

13. The fin of claim 12, wherein the amplitude and width of the major corrugations have a relationship such that the ratio of the distance "h" to the distance "w" is about 0.45 to about 0.55.

14. The fin of claim 1 wherein the number of major corrugations is about 10 to about 16 major corrugations per inch (2.54 cm).

15. The fin of claim 14 wherein the number of major corrugations is about 12 to about 14 major corrugations per inch (2.54 cm).

16. The fin of claim 1, wherein the generally flat area is generally coextensive with the reference major plane.

17. The fin of claim 1, wherein the generally flat area is generally parallel to a plane which is generally parallel to the reference major plane.

18. The fin of claim 1, wherein the generally flat area surrounding a collar has a cross-sectional area, the orifice has a cross-sectional area, and the cross-sectional area of the generally flat area is related to the cross-sectional area of the orifice by a ratio of about 1.2 to about 9.0.

19. The fin of claim 18, wherein the ratio of the cross-sectional area of the generally flat area to the cross-sectional area of the orifice is about 1.7 to about 3.6.

20. The fin of claim 1, further comprising a drainage area comprising a generally vertical channel, the channel functioning to drain from the fin liquid that may form on the fin when the fin is in a generally vertical orientation.

21. The fin of claim 20, wherein the channel is generally vertically aligned with and under at least one of the collars.

22. The fin of claim 21, wherein there are a plurality of the channels, each channel being vertically aligned with and under one of a respective plurality of the collars.

23. The fin of claim 1, wherein the major corrugations have minor corrugations along the length of the peaks and valleys, the minor corrugations being in a plane generally parallel to the reference major plane.

24. The fin of claim 23, wherein the minor corrugations have undulating angles with respect to the axes of the major corrugations of about 2° to about 8°.

25. The fin of claim 24, wherein the minor corrugations have undulating angles with respect to the axes of the major corrugations of about 4° to about 6°.

26. The fin of claim 23, wherein the minor corrugations along the peaks are in phase with the minor corrugations along the valleys.

27. The fin of claim 23, wherein the minor corrugations along the peaks are out of phase with the minor corrugations along the valleys.

28. The fin of claim 23, wherein the minor corrugations along adjacent peaks are out of phase with respect to each other and the minor corrugations along adjacent valleys are out of phase with respect to each other.

29. The fin of claim 23, wherein the minor corrugations along adjacent peaks are in phase with each other and the minor corrugations along adjacent valleys are in phase with each other.

30. The fin of claim 1, further comprising a plurality of bumps extending from at least one surface of the peaks and valleys.

31. The fin of claim 1, further comprising a plurality of dimples extending into at least one surface of the peaks and valleys.

32. The fin of claim 1, further comprising a plurality of bumps and dimples respectively extending from and into at least one surface of the peaks and valleys.

* * * * *